US010720686B2

(12) United States Patent
Chen et al.

(10) Patent No.: US 10,720,686 B2
(45) Date of Patent: Jul. 21, 2020

(54) MINIATURIZED HORIZONTAL SPLIT-WAVE ORTHOMODE TRANSDUCER

(71) Applicant: UNIVERSAL MICROWAVE TECHNOLOGY, INC., Keelung (TW)

(72) Inventors: Yu-Cheng Chen, Taipei (TW); Xuan-Wei Zhang, Keelung (TW); Jen-Ti Peng, Keelung (TW); Hsiu-Yun Liu, New Taipei (TW); Wei-Chen Chien, Taichung (TW); Hsueh-Han Chen, New Taipei (TW); Tsung-Hsien Tsai, Taichung (TW)

( * ) Notice: Subject to any disclaimer, the term of this patent is extended or adjusted under 35 U.S.C. 154(b) by 32 days.

(21) Appl. No.: 16/111,240

(22) Filed: Aug. 24, 2018

(65) Prior Publication Data

US 2020/0067158 A1 Feb. 27, 2020

(51) Int. Cl.
*H01P 1/161* (2006.01)
*H01P 5/19* (2006.01)

(52) U.S. Cl.
CPC ..... *H01P 1/161* (2013.01); *H01P 5/19* (2013.01)

(58) Field of Classification Search
CPC ..... H01P 1/161; H01P 5/19
USPC ..... 333/137
See application file for complete search history.

(56) References Cited

U.S. PATENT DOCUMENTS 8,994,474 B2 * 3/2015 Mahon ..... H01P 1/213 333/137

* cited by examiner

*Primary Examiner* — Robert J Pascal
*Assistant Examiner* — Kimberly E Glenn

(57) ABSTRACT

A novel miniaturized horizontal split-wave orthomode transducer includes a common channel portion, a first polarized channel portion and a second polarized channel portion, and the centers of the openings of the first polarized channel and the second polarized channel are coaxially and respectively arranged on two opposite sides of the common channel portion to save the bend and extended structure at the rear end of the horizontal split-wave orthomode transducer and also save the occupied space since there is no need to guide signals in one of the polarization directions to the rear and return the signals, so as to further achieve the effects of improving the flexibility of installing the transducer, providing a good isolation between electromagnetic signals in different polarization directions and preventing the interference occurred between the electromagnetic signals.

7 Claims, 10 Drawing Sheets

MINIATURIZED HORIZONTAL SPLIT-WAVE ORTHOMODE TRANSDUCER

BACKGROUND OF THE INVENTION

Field of the Invention

The present invention relates to a horizontal split-wave orthomode transducer, in particular to a novel miniaturized horizontal split-wave orthomode transducer capable of reducing its volume.

Description of Related Art

Orthomode transducer (or Orthogonal Mode Transducer, OMT) is a waveguide component that divides a received electromagnetic signal into two orthogonal electromagnetic signals and sends the orthogonal electromagnetic signals to a post-processing component for further signal processing. With the use of the orthomode transducer, both horizontal and vertical polarized electromagnetic signals can be transmitted in a signal transmission to double the transmission rate of communication systems without increasing the bandwidth. Therefore, the orthomode transducer is used extensively in communication antenna systems such as satellite receiving/transmitting communication systems, point-to-point digital microwave transmissions, etc.

To achieve a good transmission of waveguide and isolation of interference, the orthomode transducer generally comes with a waveguide path design in some of the antenna systems and thus occupies a larger volume for installing the required components, and fails to achieve the miniaturization of the antenna systems and greatly reduce the flexibility for installing the orthomode transducer in the satellite communication antenna systems.

SUMMARY OF THE INVENTION

In view of the aforementioned drawbacks of the prior art, the inventor of the present invention based on years of experience in the related industry to conduct extensive research and experiment, and finally developed a horizontal split-wave orthomode transducer capable of improving the flexibility of installing the transducer in a satellite communication antenna system to overcome the drawbacks of the prior art.

Therefore, it is a primary objective of the present invention to provide a horizontal split-wave orthomode transducer that reduces its volume to save the space occupied by the rear end of the transducer.

Another objective the present invention is to provide a good isolation of the electromagnetic signals of different polarization directions.

To achieve the aforementioned and other objectives, the present invention provides a novel miniaturized horizontal split-wave orthomode transducer, comprising: a common channel portion, a first polarized channel portion and a second polarized channel portion. Wherein, the common channel portion is for receiving a first electromagnetic signal with a first polarization direction and a second electromagnetic signal with a second polarization direction from a front end of the common channel portion and transmitting the first and second electromagnetic signals to a rear end of the common channel portion; the first polarized channel portion is coupled to a side of the common channel portion, for receiving and transmitting the first electromagnetic signal; the second polarized channel portion, coupled to the other side of the common channel portion, for receiving and transmitting the second electromagnetic signal, wherein the centers of the openings of the first polarized channel portion and the second polarized channel portion are coaxially and respectively configured on two opposite sides of the common channel portion.

In an embodiment of the present invention, the common channel portion comprises: a first polarization transition section, disposed at a front end of the common channel portion and extended in a direction towards a rear end of the common channel portion, and the rear end of the first polarization transition section being coupled to the first polarized channel portion; and a second polarization transition section, disposed at an edge of the common channel portion and proximate to the first polarization transition section, and the rear end of the second polarization transition section being coupled to the second polarized channel portion, wherein, the first polarization transition section has an electrical structure different from that of the second polarization transition section.

In an embodiment of the present invention, the electrical structure of the second polarization transition section is a guided gradient structure changed from the front end to the rear end of the common channel portion along the first axis direction as well as the second axis direction.

In an embodiment of the present invention, the second polarization transition section has a maximum width expanded in the second axis direction and not exceeding half of the width of the common channel portion along the second axis direction.

In an embodiment of the present invention, the second polarization transition section has a length along the first axis direction greater than the length of the adjacent first polarization transition section along the first axis direction.

In an embodiment of the present invention, the electrical structure of the first polarization transition section is substantially tapered from the front end to the rear end of the common channel portion along the first axis direction.

In an embodiment of the present invention, the electrical structure of the first polarization transition section includes a rectangle, and the first polarization transition section along the first axis direction has a change of external shape in the stepped manner, and the second polarization transition section also has a change of external shape in the stepped manner.

In an embodiment of the present invention, the first polarization transition section of the common channel portion comprises: a first adjustment area, a first barrier area and a first bending area. Wherein, the first adjustment area is coupled to the front end of the common channel portion; the first barrier area is coupled to the first adjustment area and has a first notch formed near an edge of the first polarized channel portion; the first bending area is coupled to the first barrier area and has a second notch formed near the rear end of the common channel portion and opposite to an edge of the first polarized channel portion.

In an embodiment of the present invention, the second polarization transition section of the common channel portion comprises: a second adjustment area, a second barrier area and a second bending area. Wherein, the second adjustment area is coupled to the front end of the first adjustment area of the first polarization transition section; the second barrier area is coupled to the second adjustment area, and the second barrier area has a length smaller than the length of the second adjustment area along the first axis direction, and the second barrier area has a length greater than the length of the second adjustment area along the second axis direction; the second bending area is coupled to the second barrier area and has an oblique notch formed near the rear end of the first barrier area.

With the arrangement of the positional relationship between the first and second polarized channels and the common channel of the present invention, the centers of the openings of the first and second polarized channels can be configured axially and respectively on both opposite sides of the common channel to skip the bended extension structure of the rear end of the conventional horizontal split-wave orthomode transducer, so as to save the distance between two outlet ends of the transducer and the occupied space of the rear end of the transducer. Therefore, the invention improves the flexibility of installation and further provides a good isolation of electromagnetic signals in the polarization direction to prevent interference between the electromagnetic signals.

DESCRIPTION OF THE INVENTION

The aforementioned and other objects, characteristics and advantages of the present invention will become apparent with the detailed description of the preferred embodiments and the illustration of related drawings as follows.

The horizontal split-wave orthomode transducer comprises a waveguide channel therein for transmitting an electromagnetic signal, and a branch channel coupled to the waveguide channel for guiding the orthogonally separated electromagnetic signals to the outside and transmitting these electromagnetic signals to a rear-end communication system. The modal transducer generally adopts a casing made of metal, and a casing wall casted on the casing for defining the external shape (or electrical structure) of the waveguide channel, so that the received electromagnetic signals in the modal transducer can be transmitted and the electromagnetic signals in different polarization directions can be separated and guided to the corresponding coupled branch channel.

To clearly describe the transmission environment of the electromagnetic signals in the modal transducer, the following is described based on the waveguide space in the modal transducer and together with the perspective drawing, wherein the waveguide space in the modal transducer is defined by the wall structure in the casing.

Figure 1:
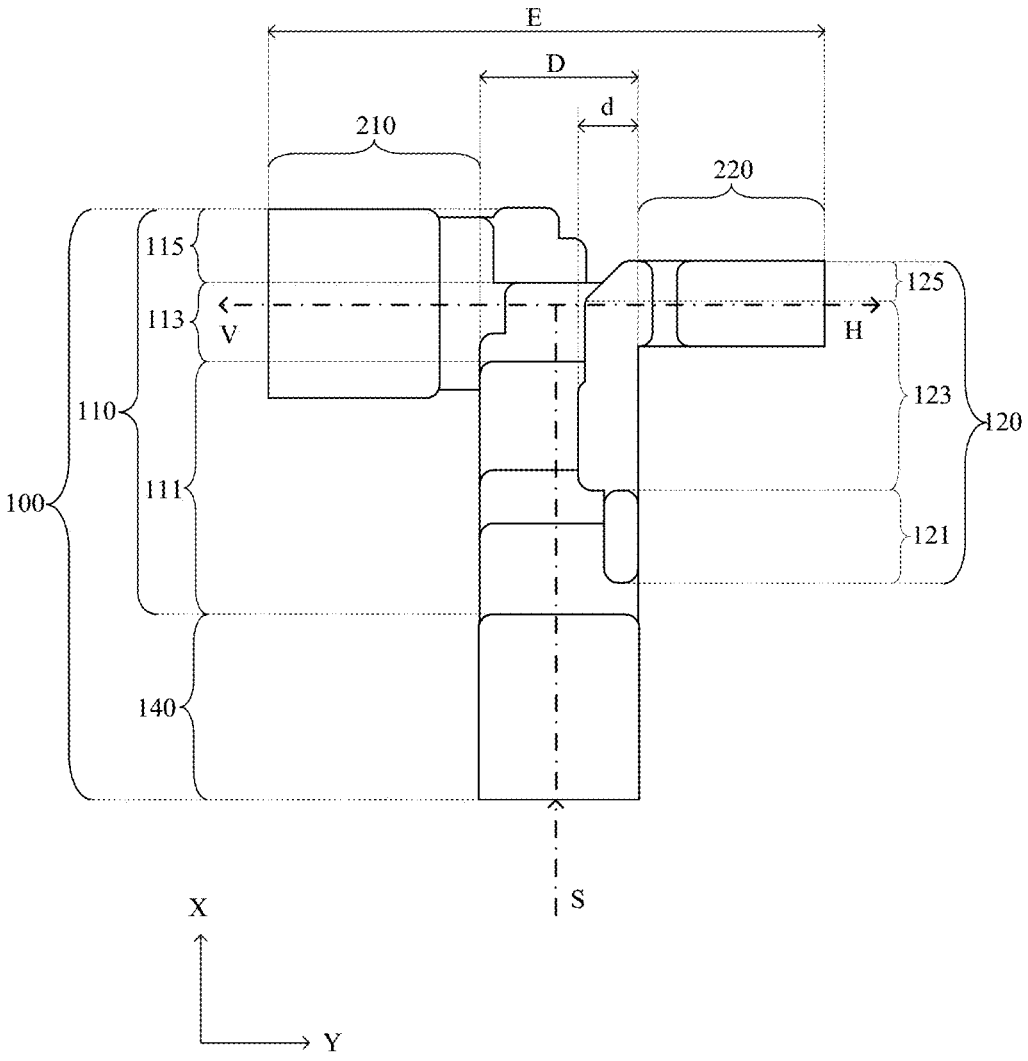
FIG. 1 is a top view of a waveguide region of an orthomode transducer (OMT) in accordance with an embodiment of the present invention.
Figure 2:
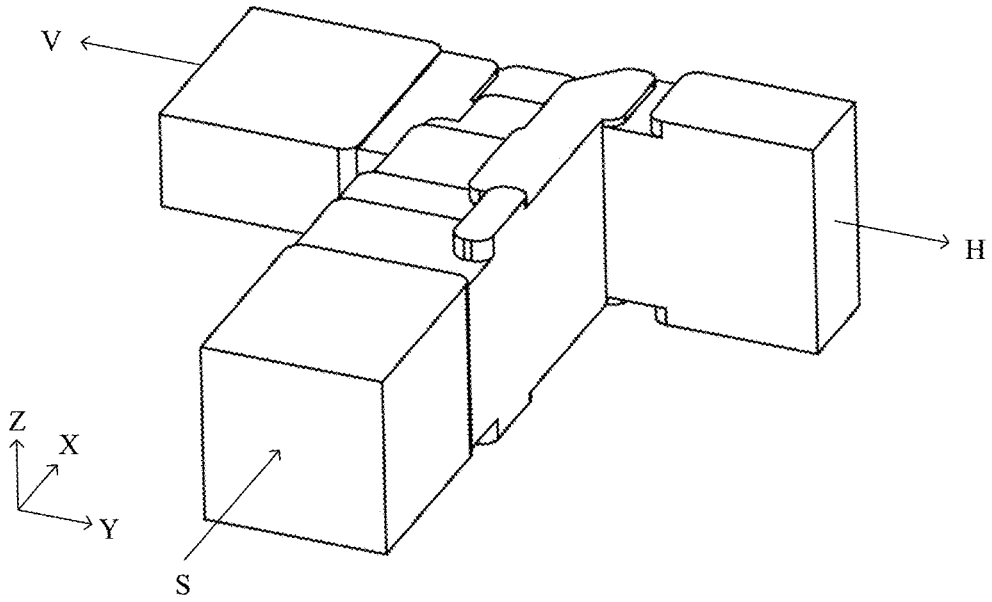
FIG. 2 is a perspective view of a waveguide region of an OMT in accordance with an embodiment of the present invention.
Figure 3:
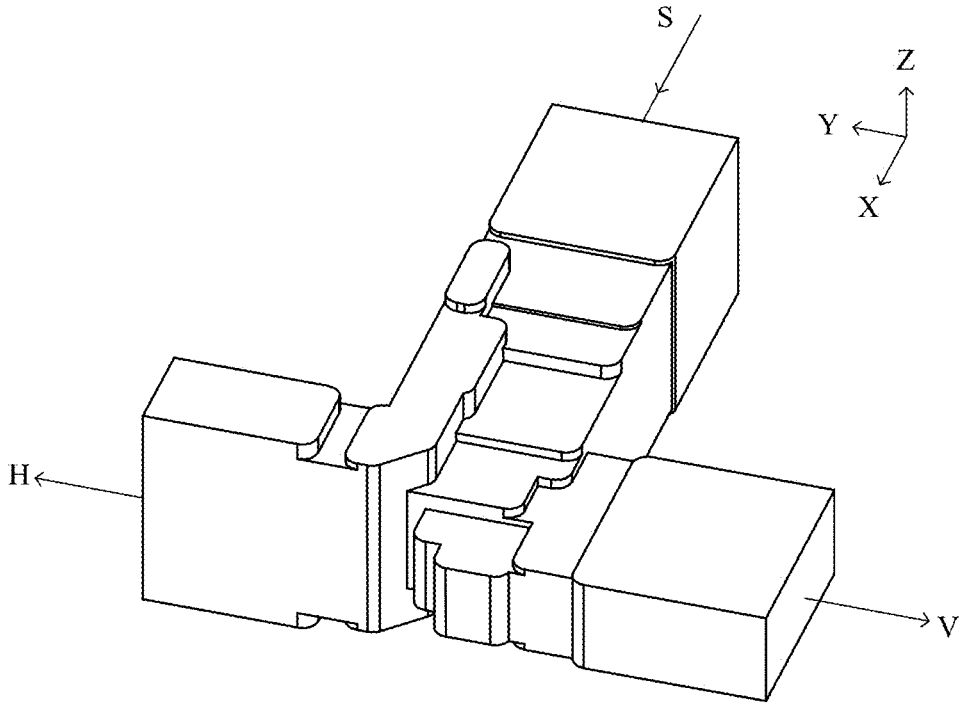
FIG. 3 is another perspective view of the waveguide region of the OMT of FIG. 2, viewing from another angle.

Please refer to FIGS. 1 to 4 for a top view of a waveguide region of an orthomode transducer (OMT) in accordance with an embodiment of the present invention, a perspective view of a waveguide region of the OMT of the embodiment as depicted in FIG. 1, another perspective view of FIG. 2, and a side view of a waveguide region of the OMT of the embodiment as depicted in FIG. 3 respectively.

FIG. 1 shows a novel miniaturized horizontal split-wave orthomode transducer of this embodiment, and the novel miniaturized horizontal split-wave orthomode transducer comprises: a common channel portion 100, a first polarized channel portion 210 and a second polarized channel portion 220. The common channel portion 100 has an end provided for receiving electromagnetic signal S, and the common channel portion 100 separates the electromagnetic signal S into two electromagnetic signals in orthogonal polarization directions (or electric field oscillation directions), so that the electromagnetic signal H with a horizontal polarization direction and the electromagnetic signal V with a vertical polarization direction are transmitted by the corresponding polarization channel portions respectively.

The first polarized channel portion 210 and the second polarized channel portion 220 are coupled to the common channel portion 100 for receiving an electromagnetic signal V in a vertical polarization direction and an electromagnetic signal H in a horizontal polarization direction. Wherein, the first polarized channel portion 210 and the second polarized channel portion 220 are arranged on both opposite sides of the common channel portion 100 respectively, so that the first polarized channel portion 210 and the second polarized channel portion 220 are horizontally configured with respect to the common channel portion 100. In other words, a common axis Y is defined at the central axis of the two polarization channel portions, wherein the common axis Y is the axis of symmetry which is the central axis of the common channel portion 100. Wherein, X-axis and Y-axis may have an intersection point or no intersection point (when both of the X-axis and Y-axis are skewed axes). The central axis X of the common channel portion 100 is defined according to the center of the front end of the common channel portion 100 (refer to the inputted direction of the electromagnetic signal S as shown in FIG. 2). In addition, the first polarized channel portion 210 and the second polarized channel portion 220 may have unequal lengths.

Since the polarization channel portions of the modal transducer are configured symmetrically with respect to the common channel portion 100, therefore it is no longer necessary to extend the rear end of the common channel portion 100 in order to configure other polarization channel portions. As a result, the additional space originally required for the rear end of the common channel portion 100 is saved to reduce the occupied volume of the orthomode transducer and improve the flexibility of installing the transducer in a satellite communication antenna system.

Further, the common channel portion 100 provided for separating two mutually orthogonal electromagnetic signals may comprise: a first polarization transition section 110 and a second polarization transition section 120. The transition sections are arranged at the common channel portion 100 and disposed in a direction from the front end to the rear end of the common channel portion 100. Since these transition sections have the function of separating the mutually orthogonal electromagnetic signals, the first polarization transition section 110 and the second polarization transition section 120 have different electrical structures, so that the electromagnetic signals received from an end of the common channel portion 100 are situated in different transmission environments, and the electromagnetic signals S are separated and divided into two mutually orthogonal electromagnetic signals.

In FIGS. 1 to 3, the rear end of the first polarization transition section 110 is coupled to the first polarized channel portion 210, and the rear end of the second polarization transition section 120 is coupled to the second polarized channel portion 220. The second polarization transition section 120 is arranged at an edge of the common channel portion 100 and near the first polarization transition section 110. In other words, the first polarization transition section 110 is disposed adjacent to the second polarization transition section 120 without any gap, or there is another section disposed at a gap between the first polarization transition section 110 and the second polarization transition section 120.

Figure 4:
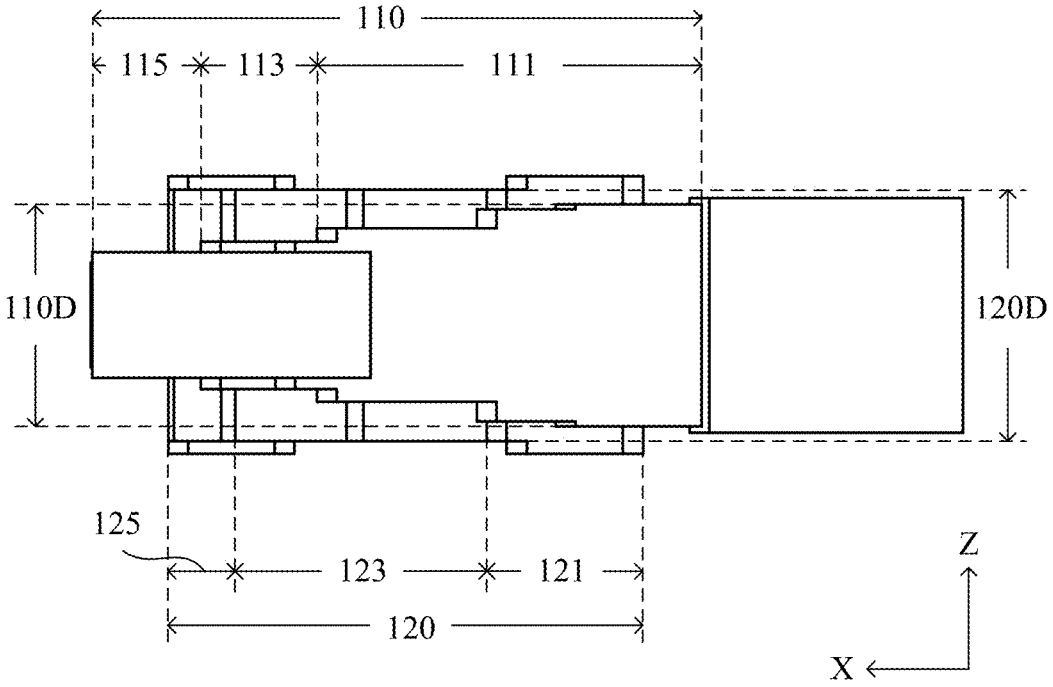
FIG. 4 is a side view of the waveguide region of the OMT of FIG. 1.

As to the transmission environment created by the electrical structure of the first polarization transition section 110 in accordance with the embodiment as shown in FIGS. 2 to 4, the first polarization transition section 110 is tapered from the front end to the rear end of the common channel portion 100. In other words, the transmission environment of the first polarization transition section 110 is gradually compressed along the first axis direction (Z-axis). In the embodiment as shown in FIGS. 2 to 4, the first polarization transition section 110 is changed along the Z-axis direction in a stepped manner, and the electrical structure of the first polarization transition section 110 may be in a rectangular shape or any other geometric shape (such as a circular shape). As long as the component of the electric field oscillated in the Z-axis direction of the electromagnetic signal S is guided to the first polarized channel portion 210, the electrical structure of the first polarization transition section 110 may be in any other tapered shape.

In FIGS. 1 and 4, the first polarization transition section 110 (from the front end to the rear end sequentially) comprises: a first adjustment area 111, a first barrier area 113 and a first bending area 115. The first adjustment area 111 is coupled to a front-end region of the common channel portion 100, and the electromagnetic signal S is received from the front end of the common channel portion 100, and then the first adjustment area 111, the first barrier area 113 and the first bending area 115 sequentially provide the transmission environments. In the embodiment as shown in FIGS. 1 and 4, the transmission environment of the first polarization transition section 110 shows a change of external shape in a tapered and stepped manner along the Z-axis direction.

Figure 8:
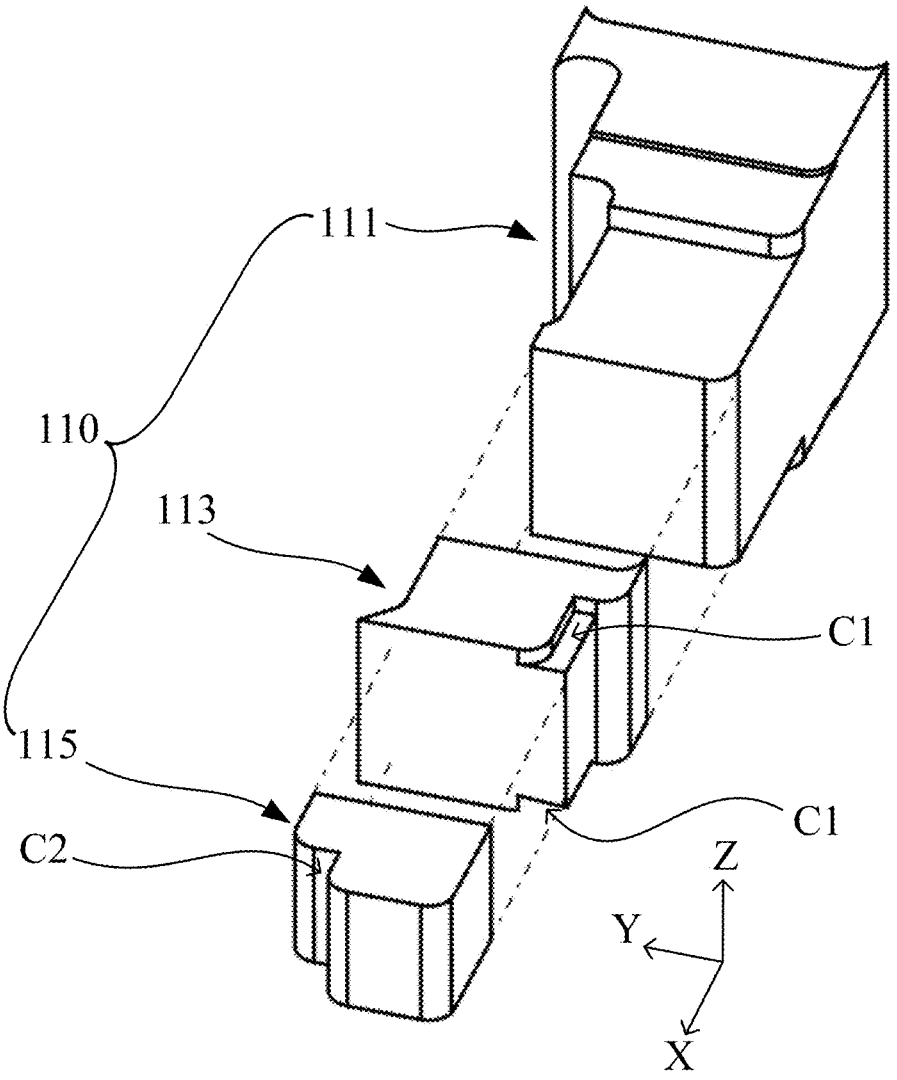
FIG. 8 is an exploded view of FIG. 7.

The first barrier area 113 is coupled to the first adjustment area 111 and has a first notch C1 formed near an edge of the first polarized channel portion 210 (see both FIGS. 1 and 8). In other words, the first barrier area 113 has a change of the external shape along the Y-axis direction in a stepped manner of different levels to provide an isolation effect of the electromagnetic signal H in the horizontal polarization direction, so that the electromagnetic signal H in the horizontal polarization direction will not be guided to the first polarized channel portion 210 easily. The first notch C1 is formed in the aforementioned stepped manner as shown in FIGS. 1 and 8, such that the existence of the first notch C1 makes a part of the first barrier area 113 to form a transmission environment of one step lower before being coupled to the first adjustment area 111. As a result, the first notch C1 and the adjacent first barrier area 113 have different external shapes in the stepped manner. In addition, the recession formed in advance just occupies less than ¼ of the top-view area of the first barrier area 113 (as shown in FIG. 1). Further, the region from the first barrier area 113 to the first adjustment area 111 has a change of the external shape in a stepped manner in different levels, wherein the first barrier area 113 and the first adjustment area 111 have different external shapes in a two-stepped manner, and the lowered first step of the first barrier area 113 is formed at the first notch C1.

The first bending area 115 is coupled to the first barrier area 113 and has a second notch C2 formed near an edge of the rear end of the common channel portion 100 (see both FIGS. 1 and 8). The second notch C2 of the first bending area 115 is arranged opposite to the output direction of the first polarized channel portion 210 (or facing the back of the output outlet). Therefore, the first bending area 115 in the horizontal polarization direction shows a change of external shape in a stepped manner to provide a guiding effect of the electromagnetic signal V in the vertical polarization direction, so that the signal may be guided to be transmitted in the output direction of the first polarized channel portion 210. The second notch C2 has an external shape in a stepped manner along the Y-axis direction (as shown in FIG. 1).

In the transmission environment created by the external structure of the second polarization transition section 120 in accordance with the embodiment as shown in FIGS. 1 to 4, the electrical structure of the second polarization transition section 120 is a guided gradient structure inversely tapered from the front end to the rear end of the common channel portion 100 (see FIG. 4) along the first axis direction (Z-axis) as well as the second axis direction (Y-axis) (as shown in FIG. 1). The second polarization transition section 120 have similar trend of changes along the first axis direction (Z-axis) and the second axis direction (Y-axis), but the trend is different from the tapered trend of the first polarization transition section 110.

In this embodiment, the second polarization transition section 120 at an exposition of the second axis direction (Y-axis) has a maximum width does not exceed half of the width of the common channel portion 100 along the same axis direction. As shown in FIG. 1, the expanded position has a maximum width d not exceeding half of the width D of the common channel portion 100. On the other hand, as shown in FIG. 4, the second polarization transition section 120 has a length (or a height) extended along the first axis direction (Z-axis) greater than the length extended along the first axis direction (Z-axis) of the first polarization transition section 110. In FIG. 4, the second polarization transition section 120 has a minimum length 120*d* greater than the maximum length 110D of the first polarization transition section 110.

With reference to FIGS. 1 to 3 and 9, the second polarization transition section 120 of this embodiment along the first axis direction (Z-axis direction) is expanded for two steps and then reduced to one step, and started from the front end of the first polarization transition section 110. Similarly, the second polarization transition section 120 is started from the front end of the first polarization transition section 110, and the second polarization transition section 120 along the second axis direction (Y-axis direction) is expanded for two steps and then reduced to one step, and finally tapered in an inclined manner.

In FIGS. 1 and 4, the second polarization transition section 120 (from the front end to the rear end sequentially) comprises a second adjustment area 121, a second barrier area 123 and a second bending area 125. The second adjustment area 121 is coupled to the front end of the first adjustment area 111 of the first polarization transition section 110. The second barrier area 123 is coupled to the second adjustment area 121, and the second barrier area 123 along the first axis direction (Z-axis direction) has a length smaller than the length of the second adjustment area 121 in the same axis direction, and the second barrier area 123 along the second axis direction (Y-axis direction) has a length greater than the length of the second adjustment area 121 in the same axis direction. The second bending area 125 is coupled to the second barrier area 123 and has an oblique notch C3 formed near the rear end of the first barrier area 113 (showing a change in an inclined manner along the Y-axis as shown in FIG. 10).

Figure 5:
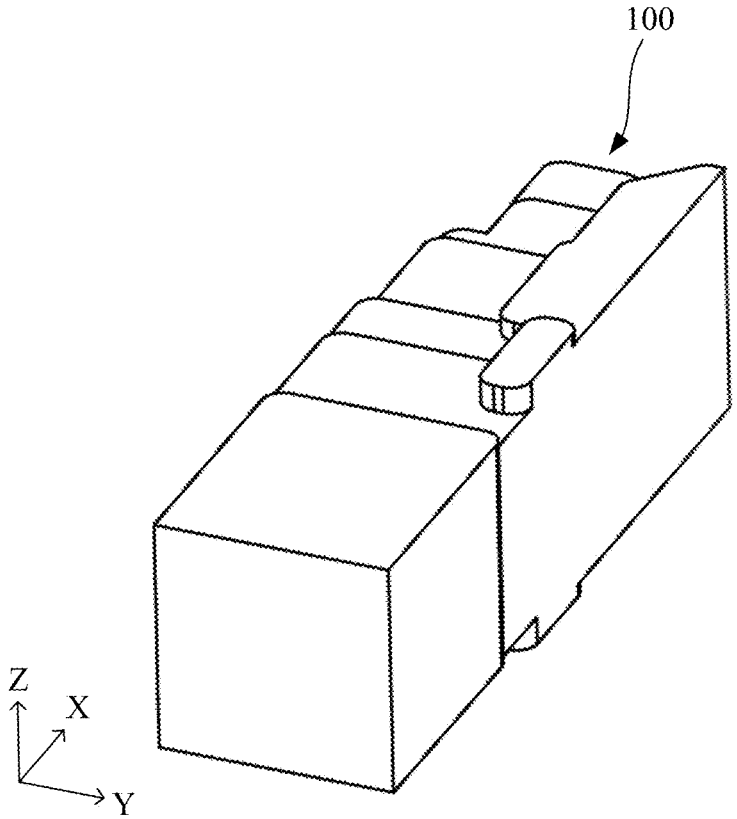
FIG. 5 is a perspective view of a common channel portion of an OMT of FIG. 1.
Figure 6:
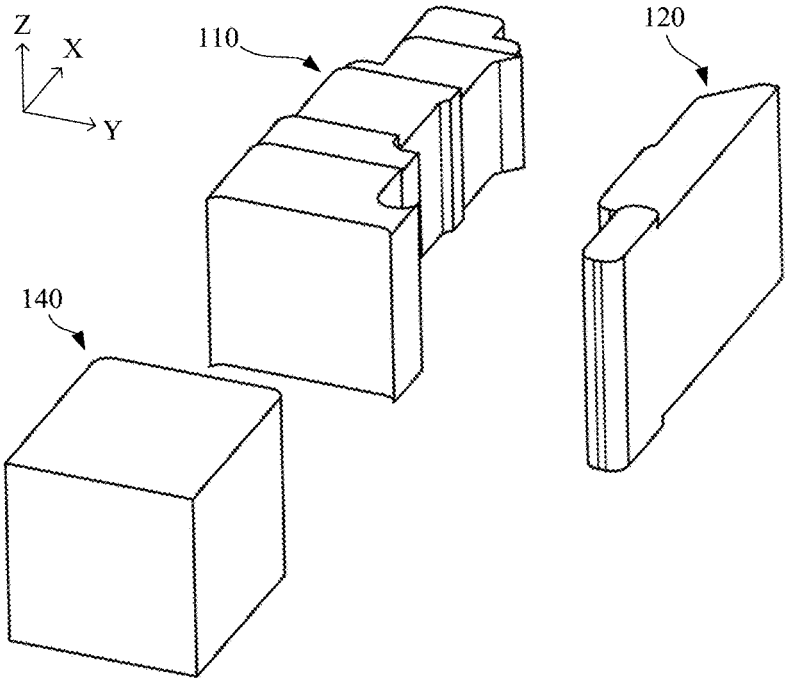
FIG. 6 is an exploded view of a common channel portion of an OMT of FIG. 1.

With reference to FIGS. 5 and 6 for a perspective view and an exploded view of a common channel portion of an OMT in accordance with an embodiment of the present invention respectively, the common channel portion 100 comprises a first polarization transition section 110, a second polarization transition section 120, and an extended transition section 140 disposed at the front end of the common channel portion 100.

Figure 7:
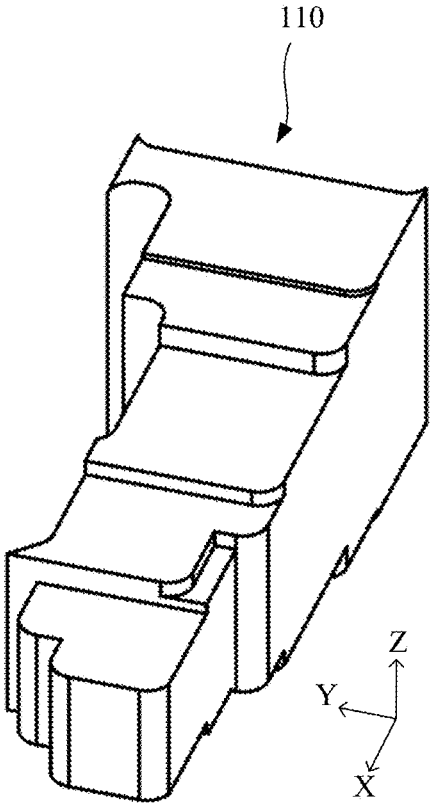
FIG. 7 is a perspective view of a first polarization transition section of an OMT of FIG. 1.

With reference to FIGS. 7 and 8 for a perspective view and an exploded view of a first polarization transition section of an OMT in accordance with an embodiment of the present invention respectively, the first polarization transition section 110 comprises a first adjustment area 111, a first barrier area 113 and a first bending area 115. FIGS. 7 and 8 further show the electrical structure of the first notch C1 and the second notch C2.

Figure 9:
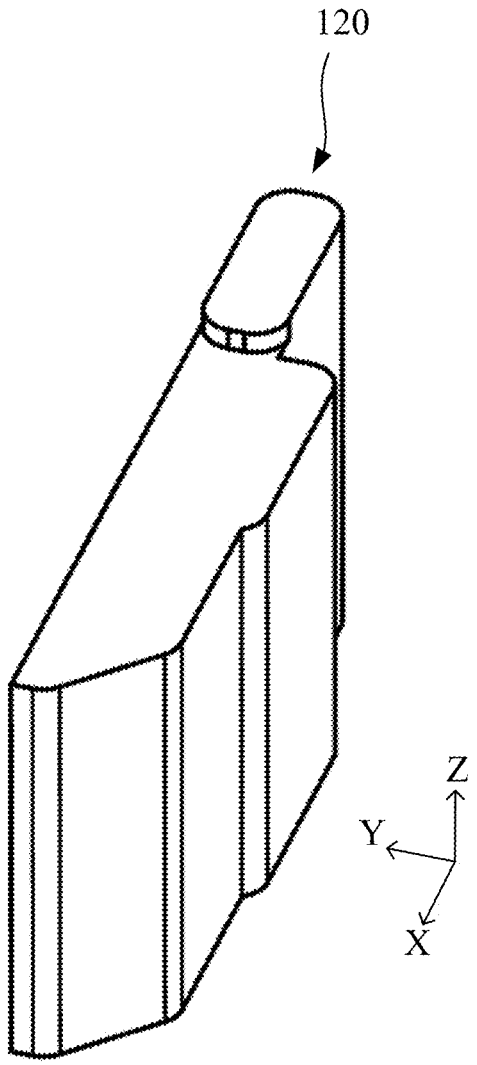
FIG. 9 is a perspective view of a second polarization transition section of an OMT of FIG. 1.
Figure 10:
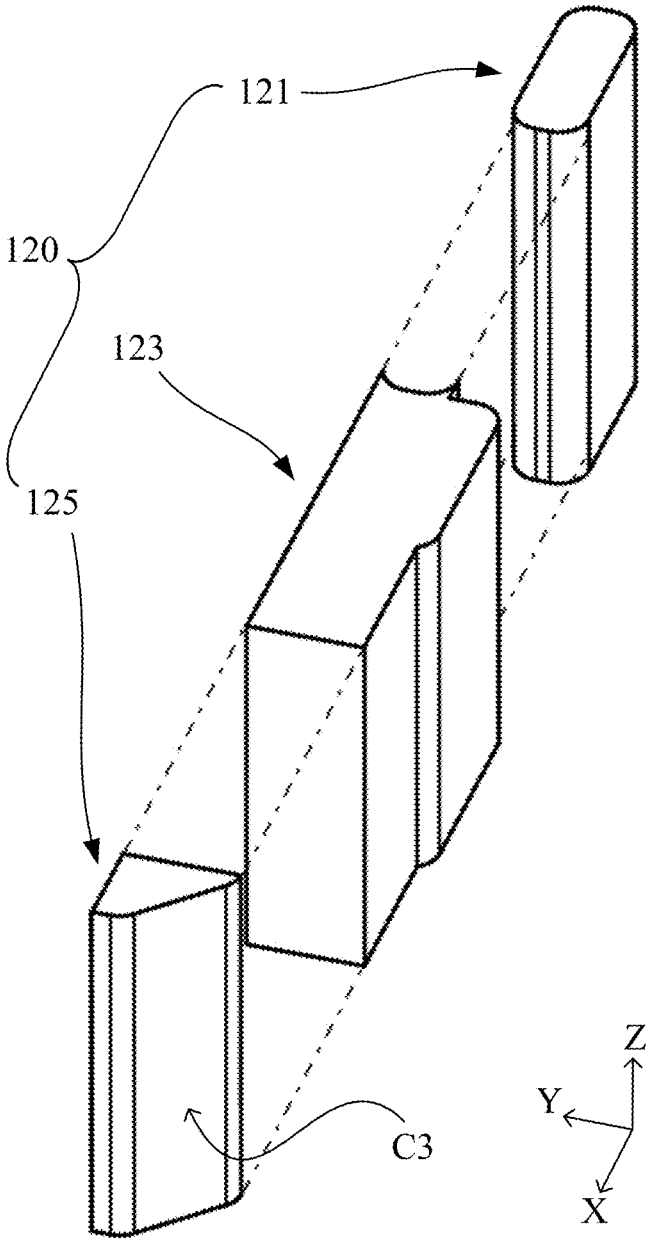
FIG. 10 is an exploded view of FIG. 9.

With reference to FIGS. 9 and 10 for a perspective view and an exploded view of a second polarization transition section of an OMT in accordance with an embodiment of the present invention respectively, the second polarization transition section 120 comprises a second adjustment area 121, a second barrier area 123 and a second bending area 125. FIGS. 9 and 10 further show the electrical structure of the oblique notch C3.

Figure 11:
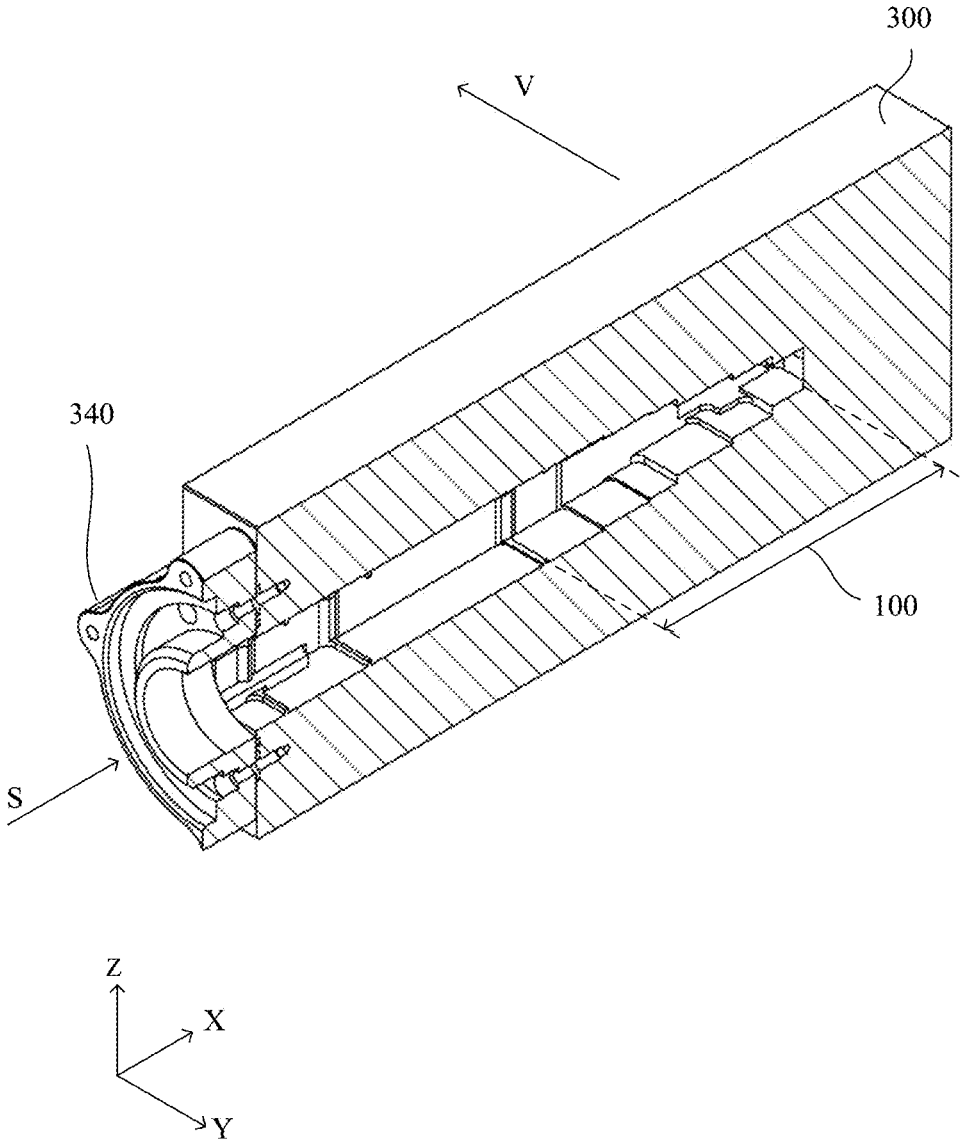
FIG. 11 is a cross-sectional view of an OMT in accordance with an embodiment of the present invention.

With reference to FIG. 11 for a cross-sectional view of an OMT in accordance with an embodiment of the present invention, a novel miniaturized horizontal split-wave orthomode transducer of the invention comprises a housing 300 with a transmission environment defined by the internal wall structure of the housing 300, and a receiving component 340 for receiving an electromagnetic signal S. The wall structure of the housing 300 defined the common channel portion 100, and the housing 300 may be formed by the wall structure by any assembling method. The housing 300 may be made of metal such as aluminum or zinc, or made of a metal alloy consisting of at least one waveguide material selected from magnesium, copper, steel, brass, or tin.

Figure 12:
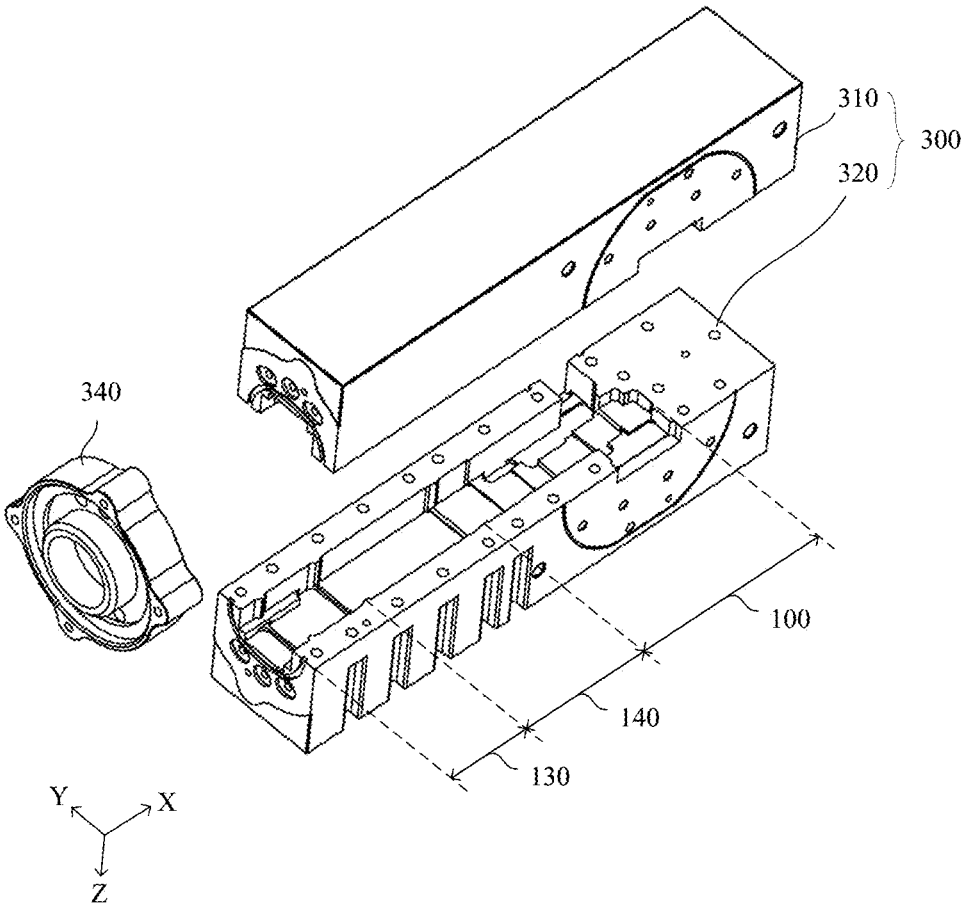
FIG. 12 is an exploded view of an OMT in accordance with another embodiment of the present invention.

With reference to FIG. 12 for an exploded view of an OMT component in accordance with another embodiment of the present invention, the novel miniaturized horizontal split-wave orthomode transducer comprises a receiving component 340 and the housing 300 coupled to the aforementioned components, wherein the housing 300 includes a first casing 310 and a second casing 320. A first concave structure inside the first casing 310 and a second concave structure inside the second casing 320 are complementary to each other and substantially mirrored, and such vertically up and down division is helpful to lower the casting processing cost.

The aforementioned concave structure constitutes the aforementioned wall structure and defines the aforementioned common channel portion. The receiving component 340 is for receiving electromagnetic signal S. Since the receiving component 340 has a circular waveguide, and a transition section is required to convert the circular shape into a rectangular shape, therefore the wall structure requires a receiving transition section 130 matched with the corresponding structure in order to feed the electromagnetic signal S into the common channel portion at the rear end successfully. In addition, the front end of the common channel portion may have an extended transition section 140 (as shown in FIGS. 1 and 6), wherein the extended transition section 140 is provided as the matched structure serving as the transition section between the receiving transition section 130 and the common channel portion 100. In addition, the front section of the concave structure of the first casing 310 and the second casing 320 have a matching structure section each for matching the received and transmitted electromagnetic signals, and the matching structure section comprises the receiving transition section 130 and the extended transition section 140.

In FIGS. 12 and 1, the electromagnetic signal may be received from the front end of the housing 300 and transmitted from the rear end of the housing 300, and a first polarized channel component (not shown in the figure) is coupled to a side of the housing 300 (wherein an inner wall structure of the first polarized channel component defines the first polarized channel portion 210), and a second polarized channel component (not shown in the figure) is coupled to the other side of the housing 300 (wherein an inner wall structure of the second polarized channel component defines the second polarized channel portion 220). Similarly to the external shape of the aforementioned polarization channel portion, the inner walls of the first concave structure 310 and the second concave structure 320 have a change of the external shape in a stepped manner.

Figure 13:
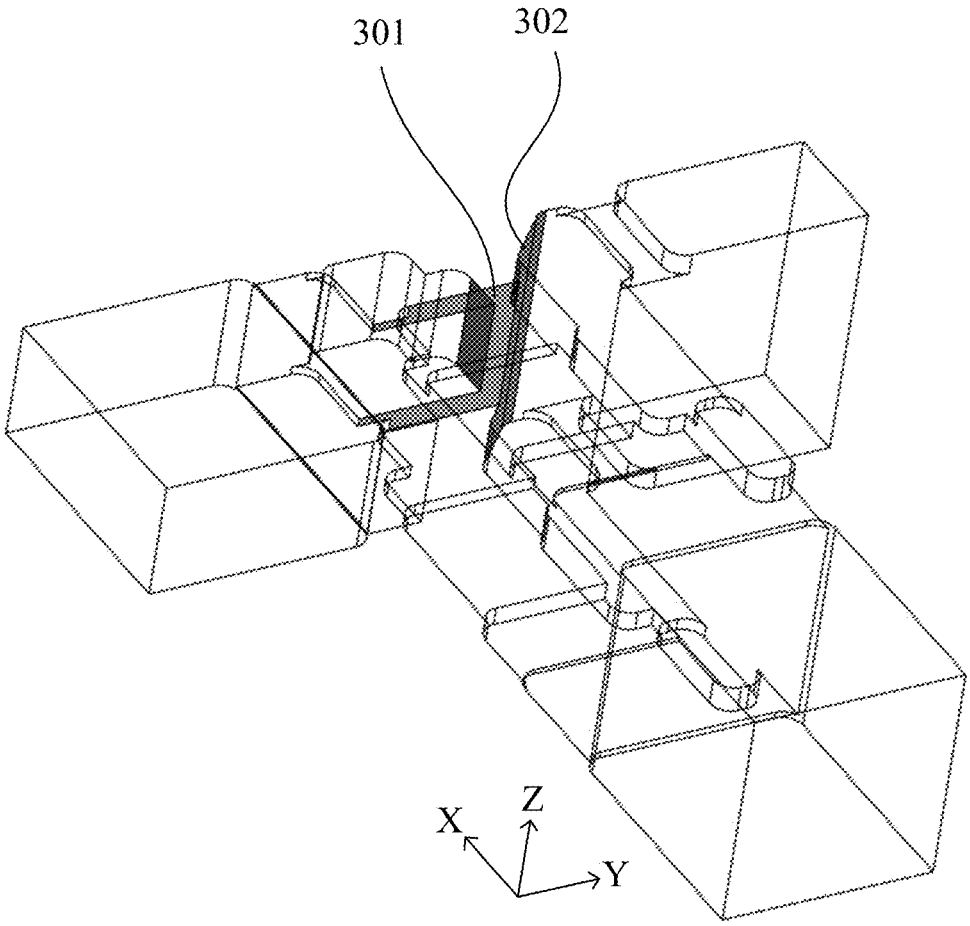
FIG. 13 is a schematic view of an isolation structure of an OMT of the present invention.

With reference to FIG. 13 for a schematic view of an isolation structure of an OMT in accordance with an embodiment of the present invention, the common channel portion defined in the housing has a first polarization transition section coupled to the first polarization component and a second polarization transition section coupled to the second polarization component. In FIGS. 13 and 3, the internal structure of the housing at the rear end of the first polarization transition section has a stop wall 301 in an "n" shape (⊐) viewing from the front end of the common channel portion along the X-axis direction, and the internal structure of the housing has a mitered wall 302 disposed at the rear end of the second polarization transition section and adjacent to the stop wall 301. With the stop wall 301 together with the mitered wall 302, the level of isolation between two electromagnetic signals of different polarization directions can be improved. In addition, distance E between two outlet ends (H, V) as shown in FIG. 1 is much shorter than a general orthomode transducer, so that the orthomode transducer of the present invention can reduce its occupied volume to improve the flexibility of installing the transducer into a satellite communication antenna system. In addition, the distance E between the two outlet ends (H, V) as shown in FIG. 1 is much smaller than that of a conventional orthomode transducer, so that the orthomode transducer of the present invention can reduce the volume occupied by the orthomode transducer to improve the flexibility of installing the orthomode transducer in a satellite communication antenna system.

In the novel miniaturized horizontal split-wave orthomode transducer of the present invention, the internal wall structure defines the waveguide space, and the wall structure of the casing of the embodiment forms the waveguide space, so that the two polarized channels may be in any casing forms or wall structures arranged on both opposite sides of the common channel. It is noteworthy that any of the aforementioned arrangements falls within the scope of the present invention.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A novel miniaturized horizontal split-wave orthomode transducer, comprising:

a common channel portion, for receiving a first electromagnetic signal with a first polarization direction and a second electromagnetic signal with a second polarization direction from a front end of the common channel portion and transmitting the first and second electromagnetic signals to a rear end of the common channel portion;

a first polarized channel portion, coupled to a side of the common channel portion, for receiving and transmitting the first electromagnetic signal; and a second polarized channel portion, coupled to the other side of the common channel portion, for receiving and transmitting the second electromagnetic signal, wherein, the centers of openings of the first polarized channel portion and the second polarized channel portion are coaxially and respectively configured on two opposite sides of the common channel portion.

2. The novel miniaturized horizontal split-wave orthomode transducer according to claim 1, wherein the common channel portion comprises:

a first polarization transition section, disposed at the front end of the common channel portion and extended in a direction towards the rear end of the common channel portion, and the rear end of the first polarization transition section being coupled to the first polarized channel portion; and a second polarization transition section, disposed at an edge of the common channel portion and proximate to the first polarization transition section, and the rear end of the second polarization transition section being coupled to the second polarized channel portion, wherein, the first polarization transition section has an electrical structure different from that of the second polarization transition section.

3. The novel miniaturized horizontal split-wave orthomode transducer according to claim 2, wherein the electrical structure of the second polarization transition section is a guided gradient structure changed from the front end to the rear end of the common channel portion along a first axis direction as well as a second axis direction.

4. The novel miniaturized horizontal split-wave orthomode transducer according to claim 3, wherein the second polarization transition section has a maximum width expanded in the second axis direction and not exceeding half of the width of the common channel portion along the second axis direction.

5. The novel miniaturized horizontal split-wave orthomode transducer according to claim 3, wherein the electrical structure of the first polarization transition section is substantially tapered from the front end to the rear end of the common channel portion along the first axis direction.

6. The novel miniaturized horizontal split-wave orthomode transducer according to claim 5, wherein the first polarization transition section of the common channel portion comprises:

a first adjustment area, coupled to the front end of the common channel portion;

a first barrier area, coupled to the first adjustment area, and having a first notch disposed proximate to an edge of the first polarized channel portion; and a first bending area, coupled to the first barrier area, and having a second notch formed at the rear end of the common channel portion and opposite to an edge of the first polarized channel portion.

7. The novel miniaturized horizontal split-wave orthomode transducer according to claim 6, wherein the second polarization transition section of the common channel portion comprises:

a second adjustment area, coupled to a front end of the first adjustment area of the first polarization transition section;

a second barrier area, coupled to the second adjustment area, and having a length smaller than the length of the second adjustment area along the first axis direction, and a length greater than the length of the second adjustment area along the second axis direction; and a second bending area, coupled to the second barrier area, and having an oblique notch disposed proximate to the rear end of the first barrier area.

* * * * *